United States Patent [19]

Martwick

[11] Patent Number: 5,067,408

[45] Date of Patent: Nov. 26, 1991

[54] CASED TELESCOPED AMMUNITION ROUND

[75] Inventor: Wilford E. Martwick, Minneapolis, Minn.

[73] Assignee: Honeywell, Inc., Minneapolis, Minn.

[21] Appl. No.: 524,619

[22] Filed: May 17, 1990

[51] Int. Cl.[5] ..... F42B 5/045

[52] U.S. Cl. ..... 102/434; 102/430; 102/464; 102/469

[58] Field of Search ..... 102/430, 433, 434, 440, 102/443, 464, 465, 467, 468, 469, 470

[56] References Cited

U.S. PATENT DOCUMENTS

| | | | |
|---|---|---|---|
| 2,853,945 | 9/1958 | Stealey | 102/468 |
| 2,866,412 | 12/1958 | Meyer et al. | 102/434 |
| 3,009,394 | 11/1961 | Kamp et al. | 102/434 |
| 4,041,868 | 8/1977 | Rayle et al. | 102/468 |
| 4,197,801 | 4/1980 | Lafeved et al. | 102/434 |

FOREIGN PATENT DOCUMENTS

| | | | |
|---|---|---|---|
| 68701 | 5/1893 | Fed. Rep. of Germany | 102/469 |
| 3403525 | 8/1985 | Fed. Rep. of Germany | 102/464 |

*Primary Examiner*—Harold J. Tudor

*Attorney, Agent, or Firm*—William T. Udseth; Edward W. Hughes

[57] ABSTRACT

A cartridge case 68 for a cased telescoped ammunition round 10. Cartridge case 68 includes a hollow cylindrical casing 12 fabricated from a material which undergoes elastic deformation when round 10 is fired from a gun, a rear seal 20 and a front seal 22. A control tube is secured to rear seal 20 and a primer is mounted to be in communication with the interior of control tube 24. Casing 12 has an axis of symmetry 18 which is also the axis of symmetry of round 10, and control tube 24. Seals 20, 22 each have side walls 48, 48' in which crimp grooves 56, 56' are formed. Each crimp groove includes a cam surface 58, 58'. Rear and front portions 14, 16 of casing 12 are crimped into grooves 58, 58'. A projectile 26 provided with a booster piston 28 is mounted within round 10 with piston 28 being located within control tube 24. The main propellant charge 38 is positioned around control tube 24 and round 26, and a booster charge is positioned with control tube 24. When round 10 is fired, axial growth of casing 12 forces portion 14, 16 to ride up cam surfaces 58, 58' expanding them. When the pressure within casing 68 returns to normal, the expanded parts of portions 14, 16 act to retract end seals 20, 22.

4 Claims, 1 Drawing Sheet

FIG. 1
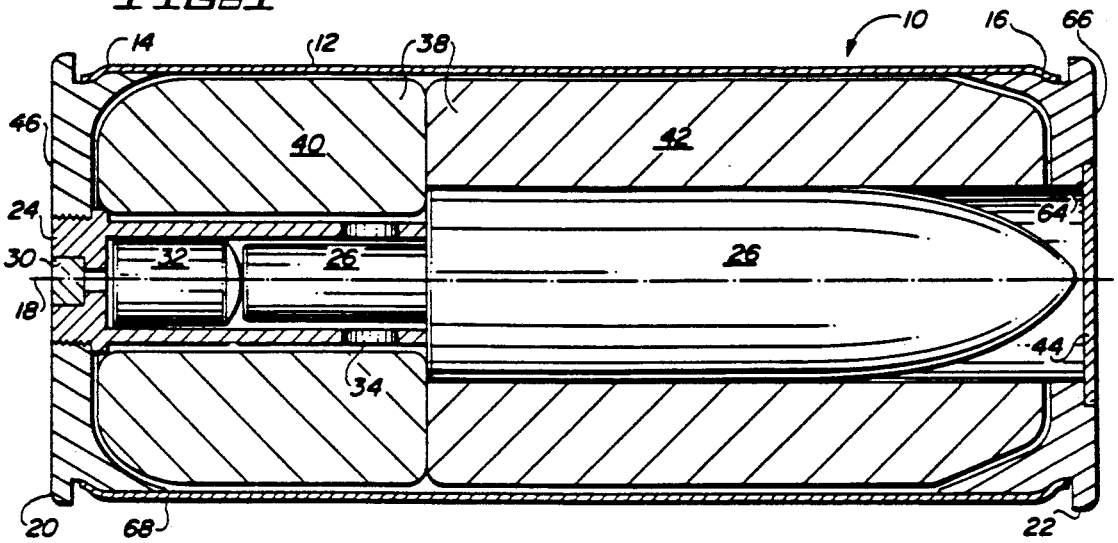
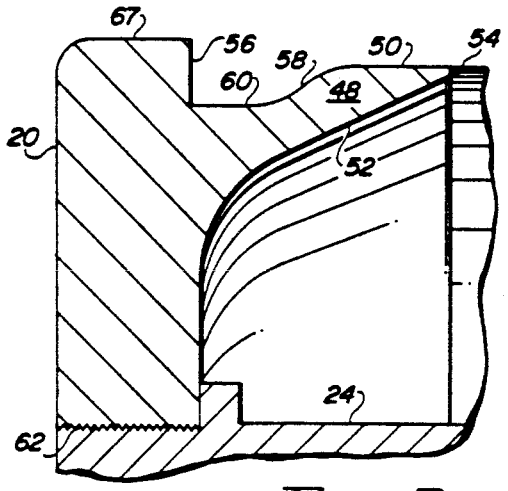
FIG. 2
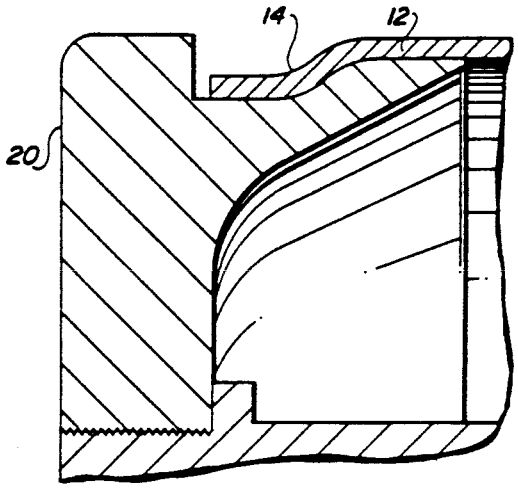
FIG. 3
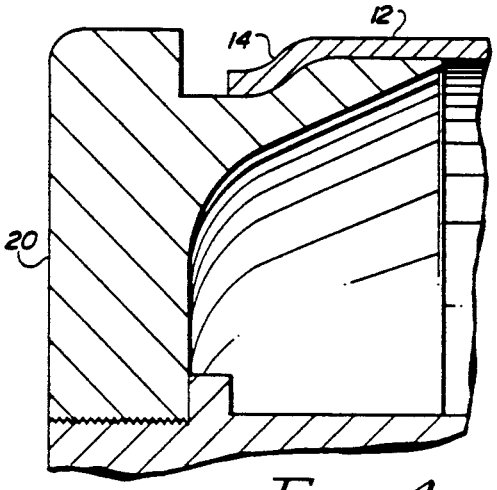
FIG. 4
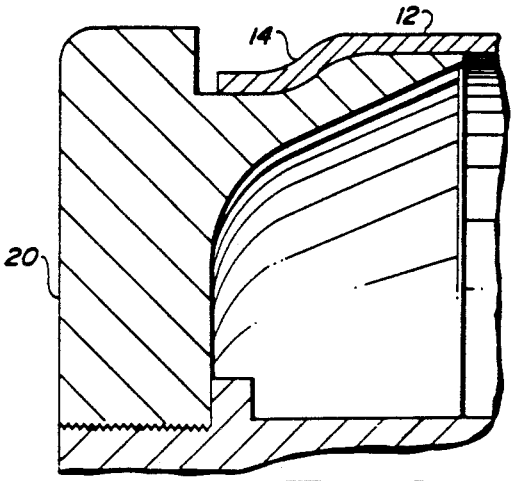
FIG. 5

CASED TELESCOPED AMMUNITION ROUND

BACKGROUND OF THE INVENTION (1) Field of the Invention

This invention is in the field of cased telescoped ammunition rounds, and more particularly relates to improvements to the cartridge case of such a round to facilitate removal of a fired cartridge case from the chamber of a gun having a high rate of fire.

(2) Description of Related Art

Cased telescoped ammunition in which the projectile is completely enclosed, or telescoped, within the cartridge case, reduces the volume and weight of a gun system firing cased telescoped ammunition compared with the weight and volume of a gun system using conventionally shaped ammunition rounds having an equivalent rate of fire. The reduced weight and volume for equivalent fire power makes such gun systems desirable for mounting in aircraft, tanks, and other mobile combat vehicles. In this application a gun system is defined to include a gun and its associated ammunition storage and feed subsystems. The benefits of using cased telescoped ammunition in a gun system derive primarily from the cylindrical shape of the cartridge case of each such round.

When a cased telescoped ammunition round is fired, the projectile is initially accelerated by a booster charge to close, or to obturate, the barrel of the gun before the main propellant charge is ignited. A control tube is commonly used to control the initial movement of the projectile. A booster charge is located in the control tube and is separated by the tube from the main propellant charge. Products of the ignited booster charge are initially confined within the control tube by a booster piston attached to the base of the projectile. Main charge ignition does not occur until the advancing piston clears the tube, or exposes or unblocks, ignition ports in the wall of the control tube, which permits products of the burning booster charge to ignite the main charge. Ignition of the main charge is controlled by the position of the projectile and its booster piston relative to the control tube.

The external surfaces of the cartridge case of a typical cased telescoped ammunition round are formed by a cylindrical outer casing, or skin, and two caps, or end seals, a front seal and a rear seal. Each such round is loaded into a cylindrical gun chamber, or chamber, of the gun from which the round is to be fired, and from which the spent cartridge case is removed, or unloaded, after firing before another cycle of loading, firing and unloading begins. In guns from which such rounds are typically fired, the chamber housing in which a number of gun chambers may be formed can take the form of a cylinder which is rotated about its axis of symmetry similar to the rotation of the cylinder of a hand held revolver, for example. In such a gun system the rounds are mechanically loaded into into a given gun chamber when that chamber has a given orientation, position, or station, relative to the gun barrel. The chamber housing is then rotated to bring the gun chamber into which a round has been loaded into alignment with the gun barrel ready for firing. After firing, the chamber housing is again rotated to another position so that the gun chamber with the cartridge case of the fired round, the spent cartridge case, can be removed from the gun chamber. Alternatively, the chamber housing may be moved linearly with respect to the gun barrel to position a gun chamber in a loading station where a round can be loaded into the chamber, the chamber housing is then moved to align the loaded gun chamber with the gun barrel. When the round is fired, the chamber housing is moved so that the gun chamber with the spent cartridge case is at its unloading station where the spent cartridge case is removed from the chamber prepatory to another round being loaded into it. In such a gun, the loading and unloading stations for a given chamber may be the same. Cased telescoped ammunition obviously can also be fired from more conventionally operating guns firing projectiles of from 20 to 45 mm. for example.

When the interior of the cartridge case is pressurized by the burning of the propellant within the cartridge, the outer skin, or outer casing and the end seals function to prevent gun gas from escaping between the the chamber housing and the breech and barrel faces of the the gun. The pressure created by the burning propellant forces the end seals apart until they are constrained by the breech face of the gun forming one end of the gun chamber and by the the barrel face of the gun barrel which forms the other end of the gun chamber. This pressure also forces the lips of the end seals radially outward into intimate contact with the skin, and both together into intimate contact with the inner cylindrical surface of the gun chamber. The pressure of the gases produced by the burning propellant also forces the outer casing, or skin, of the cartridge case radially outward into intimate contact with the inner cylindrical surface of the gun chamber formed in the chamber housing. After such contact has been achieved, the pressure produced by the burning propellant acts to elastically deform the chamber housing, enlarging the diameter of the gun chamber and forcing apart the breech face and the barrel face of the gun. When the pressure within the cartridge case is relieved after the projectile exits the muzzle of the gun barrel, the gun and the chamber revert to their unpressurized dimensions. However, changes in the dimensions of the cartridge case experienced during firing can cause nonelastic changes in the dimensions of the cartridge case, so that the dimensions of the cartridge case do not return to the dimensions they possessed prior to the round being fired.

To extract a spent cartridge case after it has been fired, it is necessary in a gun with a movable chamber housings to move the chamber housing so that the gun chamber in which the spent cartridge case is located can be moved to its unloading position, or station. For such movement to take place as quickly as possible while requiring the minimum amount of force to accomplish such movement, it is necessary that there be sufficient clearance between the end seals of the spent cartridge and the breech face and the barrel face of the gun to minimize frictional resistance to the movement of the chamber housing. To quickly and easily remove the spent cartridge case from the gun chamber, it is important that the cartridge casing not press against the inner cylindrical surface of the gun chamber and that the spent cartridge case be sufficiently intact so that all components of the spent cartridge case can be removed together, or as an entity.

Because of the elastic deformation occurring in a gun firing cased telescoped ammunition is so large, there is a need for an improved cartridge case for a cased telescoped ammunition round that provides adequate and proper clearance between the end seals and the breech face and the barrel face of the gun after the round has been fired as well as between the cartridge casing and the surface of the gun chamber while maintaining the integrity of the spent cartridge casing to facilitate its removal.

To reduce the pressure exerted by the outer casing, or skin, of a spent cartridge case of such a round on the surface of the gun chamber within which the round is fired, and thus the force needed to remove the spent cartridge case, the skin, or outer casing, can be designed to split longitudinally when fired which minimizes any pressure exerted by the outer casing against the inner surfaces of the gun chamber after the gun chamber returns to its initial dimensions, the dimensions it had immediately prior to the round being fired. In such rounds the end seals are free to move relative to the outer casing which requires special means to maintain the integrity of the casing i.e., the necessary degree of connection between the end seals and the split casing so that they can be removed as a single entity. Typically, the joint between the end seals and the casing includes a sealant to prevent moisture and contaminants from entering the round, but such joints are not strong enough to maintain the integrity of a spent cartridge case with the degree of reliability required so that the problem of removing a spent cartridge case as a single entity quickly, and completely with a minimum amount of energy is not consistently achieved.

SUMMARY OF THE INVENTION

The present invention provides an improved cartridge case for a cased telescoped ammunition round. The cartridge case of the round includes a hollow cylindrical outer casing the axis of which is also the axis of symmetry of the round, front and rear seals, a control tube and an igniter. The outer casing is fabricated from a material which undergoes both plastic and elastic deformation when the round is fired. The front and rear seals each have a base and an annular side wall formed integrally with its base. The side wall of each seal has a cylindrical outer surface and an outwardly tapering inner wall. The side wall of each seal terminates in a lip. An annular crimp groove is formed in the outer surface of the side wall of each seal near its base. A wall of each groove nearest the lip forms a cam surface. Each crimp groove has a bottom wall surface substantially parallel to the outer surface of the seal. A front portion of the outer casing fits over side wall of the front seal and is crimped into the crimp groove of the front seal with the inner surface of the outer casing in substantial contact with the cam surface and the bottom wall surface of the crimp groove. The rear portion of the outer casing fits over the side wall of the rear seal and is crimped into the crimp groove of the rear seal with the inner surface of the outer casing in substantial contact with the cam surface and the bottom wall surface of the crimp groove of the rear seal. A hollow cylindrical control tube is attached to the rear seal so that the control tube is symmetric with the axis of symmetry of the round. A projectile which has a booster piston secured to its base is positioned in the cartridge case with the booster piston located in the control tube. A booster propellant is positioned within the control tube between the primer, or igniter, and the free end of the booster piston. The primer which ignites the booster propellant is mounted in the rear of the control portion of the control tube. The main propellant charge is positioned around the control tube and the projectile, within the outer casing, and between the front and rear seals.

Axial growth of the casing occurs when the round is fired. This change in dimension forces the small diameter of the outer casing crimped into the crimp groove of the front and rear seals to expand as these portions ride up the cam surface of each seal. The stress induced in the expanded crimped portions of the outer casing is relieved when the pressure of the gases produced by the ignited main propellant within the cartridge case returns to ambient which causes this small diameter to try to return to its original size which acts on the cam surfaces to retract the end seals. The circumference of the outer casing of the spent round, or cartridge case, substantially returns to its initial value because during firing it has primarily undergone elastic deformation. As a result, the seals do not press against the barrel face and breech face of the gun after the round is fired, and no significant frictional force is present to oppose movement of the chamber housing due to the seals pressing against the barrel face and breech face of the gun after a round is fired. Since the outer casing is made of a material that undergoes elastic deformation when the round is fired, the diameter or circumference of the outer casing returns to its initial value. As a result, there is no significant resistance provided by the outer casing pressing against the chamber housing when the spent round is removed from the chamber.

The only connection between the end seals, or the end caps, is provided by the outer casing. The connection between the outer casing and the end seals to which the outer casing is crimped is sufficient to maintain the integrity of the spent cartridge case so that it can be removed as an entity from the gun chamber from which it is fired.

It is, therefore, an object of this invention to provide an improved cartridge case for a cased telescoped ammunition round in which the only connection between the front and rear seals of the cartridge case is provided by the outer casing of the cartridge case.

It is another object of this invention to provide a cartridge case for a cased telescoped ammunition round that facilitates removal of the cartridge case from the gun chamber from which the round was fired.

It is yet another object of this invention to provide a cartridge case for a cased telescoped ammunition round in which the outer casing of the cartridge case is fabricated from a material which undergoes elastic deformation when the round is fired and in which the end seals are retracted after a round is fired by action of the the portions of the outer casing crimped into crimp grooves in the seals acting on cam surfaces of the grooves.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which:

FIG. 1 is a section of a cased telescoped ammunition round of a preferred embodiment of a cartridge case embodying this invention.

FIG. 2 is an enlarged fragmented sectional view of an end seal showing details of the crimp groove.

FIG. 3 is an enlarged fragmented sectional view of a an end seal and the portion of the outer casing crimped into the crimp groove of the seal prior to be round being fired.

FIG. 4 is an enlarged fragmented sectional view similar to FIG. 2 showing axial displacement of the outer casing relative to the end seal when the pressure of the burning propellant of the round is at its maximum.

FIG. 5 is an enlarged fragmented sectional view similar to FIG. 2 showing the position of the crimped portion of the outer casing relative to the crimp groove of an end seal after the round has been fired.

DETAILED DESCRIPTION

In FIG. 1 cased telescoped ammunition round 10 includes an outer casing, or skin, 12, which except for rear portion 14 and front portion 16 of outer casing 12 is a right circular hollow cylinder. Axis 18 of round 10 is the axis of symmetry, or longitudinal axis of casing 12. Rear seal 20 closes off the rear end of casing 12, and front seal 22 closes off the front end of casing 12. Control tube 24 is also a right circular hollow cylinder one end of which is secured to rear seal 20 so that the axis of symmetry, or longitudinal axis of control tube 24 substantially coincides with axis 18.

Projectile 26 is provided with a booster piston 28, which is mounted on the base of projectile 26. When round 10 is assembled, booster piston 28 is positioned within a portion of control tube 24. Primer, or igniter, 30 is mounted in the rear end of control tube 24, and booster charge 32 is positioned within control tube 24 between booster piston 28 and igniter 30. Ignition ports, or vents, 34 are formed through the side walls of control tube 24. Vents 34 are initially blocked, or closed, by booster piston 28. Two segments of the main propellant 38 of round 10, rear segment 40 and front segment 42 are positioned around control tube 24 and projectile 26 within casing 12 and between end seals 22 and 24. Segments 40, 42 are formed by consolidating propellant grains. The inner diameter of front segment 42 is greater than that of rear segment 40 so that front segment 42 can fit around projectile 26. The central opening in front seal 22 is closed by environmental seal 44 which is made of a suitable material, such as aluminum foil. The function of seal 44 is to prevent elements of the environment external to round 10 such as moisture, dirt, etc. from entering round 10 and adversely impacting the performance of the round.

In FIG. 2 details of end seals 20, 22, particularly with reference to rear seal 20, relevant to this invention, are illustrated. Rear seal 20 has a base 46 and an annular side wall 48. Side wall 48 has a cylindrical outer surface 50 and an outwardly tapering inner surface 52. Side wall 48 terminates in a thin lip 54. An annular crimp groove 56 is formed around the exterior of side wall 48. Wall 58 of groove 56 defines a cam surface which is tangent to the base 60 of groove 56 and outer surface 50 of side wall 48. Since in FIG. 2 rear seal 20 is illustrated, the base 46 of rear seal 20 has a threaded opening 62 into which one end of control tube 24 is threaded as illustrated in FIG. 1.

Except for the diameter of opening 64 in the base 66 of front seal 22 which is made large enough so that projectile 26 can pass through it when round 10 is fired, front seal 22 is substantially the equivalent of rear seal 20. Thus, elements of front seal 22 which are the same as those of rear seal 20 will have the same reference number except for being primed.

In the preferred embodiment outer casing 12 is made out of a material which has a high yield to strength modulus such as 17-7 stainless steel. Other materials have a similar yield to strength modulus such as titanium, can also be used. The rear and front portions 14, 16 of outer casing 12 are annealed so that these portions can be crimped into crimp grooves 56, 56' of end seals 20, 22. When round 10 is assembled, the joints between seals 20, 22 and portions 14, 16 of casing 12 are environmentally sealed by a sealant such as a room temperature vulcanizing silicone which is not illustrated. A significant feature of round 10 is that components such as rear seal 20, control tube 24 with primer 30 positioned within it, booster charge 32, projectile 26, booster piston 28 and segments 40, 42 of main propellant 36 can be assembled as a unit and slid into outer casing 12. Front seal 22 is inserted into the front end of casing 12 and then portions 14 and 16 of casing 12 are crimped into crimp grooves 56, 56'. Opening 64 in front seal 22 is closed by environmental seal 44 to complete the assembly of round 10. The length of cartridge 10 is the sum of the lengths of cylindrical sections 67, 67' of end caps 20, 22 and the length of casing 12.

In the typical gun system which is not illustrated, a round 10 is loaded into a gun chamber in a chamber housing of the gun. The housing is moved to align the chamber containing round 10 with the gun barrel. The gun chamber is defined by a breech face, the inner cylindrical surface of the gun chamber, and the face of the gun barrel. Round 10 is fired by a mechanism in the breech of the gun which drives a firing pin into primer 30, or which discharges an electrical current through primer 30. Primer 30 when initiated ignites booster charge 32. Pressure of the gases released by burning booster charge 32 act on the exposed end of booster piston 28 to accelerate projectile 26 out of round 10 into the forcing cone of the gun barrel. As projectile 26 moves forward, booster piston 28 exposes, or unblocks, vents 34 in control tube 24 so that the ignition products produced by booster charge 32 ignite main propellant 38. Burning propellant 38 produces gases having a very high pressure and temperature that act against seals 20, 22 and outer casing 12, as well as on projectile 26 to accelerate projectile 26 to a desired muzzle velocity as projectile 26 exits the gun barrel.

As the pressure of the gases, gun gas, produced by burning propellant 38 increases, the lips 54, 54' of end seals 20, 22 expand against the inner surface of skin 12 and together the press against the chamber wall to seal the ends of the gun chamber so that no hot gas produced by the burning propellant 38 impinges on the wall of the gun chamber and no such gas can escape from the gun chamber between the chamber housing and the breech and barrel faces of the gun. The pressure of the gun gas forces end seals 20, 22 apart until they are constrained by the breech and barrel faces of the gun. This pressure also forces the outer casing 12 outwardly against the inner cylindrical surface of the chamber housing in which the gun chamber is formed. After such contact has been established and as the pressure of the gas within cartridge case 68 which includes casing 12 and end seals or caps 20, 22 approach its maximum, this pressure is sufficient to elastically deform the chamber housing, enlarging the diameter of the gun chamber as well as forcing apart the breech and barrel faces of the gun.

Axial growth of cartridge case 68 is accommodated by the action of the crimped end portions 14, 16 of casing 12 in crimp grooves 56, 56' of end caps 20, 22. In FIG. 3 the position of rear portion 14 in crimp groove 56 of rear end cap 20 is that occupied by it after round 10 is assembled and prior to round 10 being fired. It should be noted that the inner surface of portion 14 is in substantial contact with the base 60 and cam surface, or ramp, 58 of crimp groove 56 at this time.

As seals 20, 22 are forced apart by the pressure of the gases produced by the burning propellant, the portions 14, 16 of casing 12 are forced to yield and to increase in diameter to accommodate the ramp, or cam surfaces, 58, 58' of crimp grooves 56, 56' of end caps 20, 22. FIG. 4 illustrates these changes at the time the pressure within cartridge case 68 is at its maximum.

After projectile 26 exits the muzzle of the barrel, the pressure within cartridge case 68 quickly decreases toward ambient at which time the gun and its chamber housing revert to their unpressurized dimensions. When the pressure within the cartridge case 68 returns to normal, or ambient, the residual stress in crimped portions 14, 16 of casing 12 acts to return to a smaller diameter which retracts end caps 20, 22 to an extent dependent on the shape, or design, of cam surface, or ramp, 58. FIG. 5 illustrates the relationship between crimped rear portion 14 of casing 12 and rear seal 20 after round 10 has been fired and the pressure within cartridge case 68 has returned to substantially ambient conditions. A similar relationship exists at front seal 22. Thus, there is no frictional force opposing movement of the chamber housing of the gun caused by seal 20, and 22 pressing against the breech and barrel faces of the gun.

Radial clearance after firing between casing 12 and the cylindrical surface of the chamber housing defining the gun chamber within which round 10 is fired is attained because the yield strength of casing 12 divided by the modulus of the material from which casing 12 is made, 17-7 stainless steel in the preferred embodiment is greater than the elastic deformation in inches/inch of the diameter of the gun chamber. As a result casing 12 will return to a state where its diameter is less than the diameter of the gun chamber. Thus, no significant frictional force is created by casing 12 pressing against the surface of the gun chamber to resist removal of cartridge case 68.

Because seals 20, and 22 are secured to casing 12 only by portions 14, 16 being crimped into crimp grooves 56, 56' of seals 20, 22, and because casing 12 remains intact after round 10 is fired, the integrity of the spent cartridge case 68 is maintained so that all the elements of spent cartridge case 68 can be removed from a gun chamber from which round 10 is fired as an entity and with a minimum expenditure of energy.

From the foregoing, it is readily apparent the present invention provide an improved cartridge case for a cased telescoped ammunition round that is easily assembled and provided positive length control. It should, therefore, be evident that various modification can be made to the described invention without departing from the scope of the present invention.

What is claimed is:

1. A cased telescoped ammunition round comprising:

a hollow cylindrical outer casing having a rear portion, a front portion, an axis of symmetry, and a circumference, said outer casing being fabricated from a material which undergoes elastic deformation when the round is fired;

a rear seal;

a front seal;

the front seal and the rear seal each having a base, and an annular side wall integral with its base, the side walls having cylindrical outer surfaces, and outwardly tapering inner walls, the side walls terminating in lips;

annular crimp grooves formed in the outer surfaces of the side walls proximate the bases of the end seals, walls of the grooves nearest the lips forming cam surfaces, the crimp grooves each having a base that is substantially parallel to the outer surface of the end seals, the cam surfaces of crimp grooves being respectively tangent to both the bases of the crimp grooves and to the cylindrical outer walls of the front and rear seals;

the rear portion of the outer casing fitting over the side wall of the rear seal and being crimped into the crimp groove of the rear seal;

the front portion of the outer casing fitting over the side wall of the front seal and being crimped into crimp the groove of the front seal;

only the rear and front portions of the outer casing being annealed prior to being crimped into the crimp grooves of the rear and front seals;

a hollow cylindrical control tube having a front end and a rear end, the rear end of the control tube being secured to the base of the rear seal so that the control tube is substantially symmetrical with respect to the axis of symmetry;

a projectile, a portion of the projectile fitting into the control tube;

a main propellant charge positioned around the control tube, within the casing and between the rear and front seals;

a booster propellant positioned within control tube; and primer means mounted in the control tube for igniting the booster charge and the main propellant charge when the primer means is initiated when the round is fired;

axial growth of the round occurring when the round is fired from a gun having a chamber housing forcing the portions of the outer casing crimped into the crimp grooves of the front and rear seals to ride up the cam surfaces of the seals expanding the diameter of the crimped portions of the outer casing, the stress induced in the expanded crimped portions of the outer casing retracting the end seals when the pressure of gases produced by the ignited main propellant charge within the round returns to ambient pressure; the circumference of the outer casing substantially returning to its initial value prior to being fired when the pressure within the round returns to ambient pressure; and the pressure of gases produced by the ignited main propellant charge acting on side walls of the seals pressing the lips of the seals against the outer casing constrained by the chamber housing with sufficient force to prevent gas produced by the burning main propellant charge from escaping between the seals and the outer casing, the lips of the seals substantially returning to the position occupied by each prior to the round being fired when the pressure within the outer casing returns to ambient pressure after the round is fired.

2. A cased telescoped ammunition round as set forth in claim 1 in which the outer casing is fabricated from a single layer of 17-7 stainless steel.

3. In a cased telescoped ammunition round having a hollow cylindrical outer skin having a rear portion, and a front portion, a rear seal, a front seal, and an axis of symmetry; the improvements comprising:

fabricating the outer skin from a stainless steel;

the rear seal and the front seal each having a base and an annular side wall integral with its base, each side wall of the seals having a cylindrical outer surface and an outwardly tapering inner wall terminating in a lip, a crimp groove formed in the outer surface of the side wall of each seal, a wall of the crimp grooves of each seal nearest the lips forming a cam surface; the rear portion of the outer skin being crimped into the crimp groove of the rear seal and the front portion of the outer skin being crimped into the crimp groove of the front seal; only the front and rear portions of the outer skin being annealed prior to being crimped into the crimp grooves of the front and rear seals;

during firing of the round, radial expansion of the outer skin causing elastic deformation of the outer skin, and axial growth of the round forcing the front and rear portions of the outer skin crimped into the crimp grooves of the front and rear seals to ride up the cam surfaces of said grooves, expanding the diameter of the crimped portions of the outer skin, the stress induced in the expanded crimped portions retracting the end seal when the pressure within the round returns to ambient.

4. In a cased telescoped ammunition round as defined in claim 3 in which the outer skin is fabricated from a single layer of 17-7 stainless steel.

* * * * *